US005370435A

United States Patent [19]

Monk et al.

[11] Patent Number: 5,370,435

[45] Date of Patent: Dec. 6, 1994

[54] CONTAINER HANDLING APPARATUS

[75] Inventors: James T. Monk; Tonnie M. Boyles, both of Louisville, Miss.

[73] Assignee: The Taylor Group, Inc., Louisville, Miss.

[21] Appl. No.: 49,566

[22] Filed: Apr. 19, 1993

[51] Int. Cl.[5] ..... B66F 9/18

[52] U.S. Cl. ..... 294/81.54; 294/81.21; 414/607; 414/621

[58] Field of Search ..... 414/607, 619, 621, 626; 294/119.1, 81.21, 81.53, 81.54

[56] References Cited

U.S. PATENT DOCUMENTS

| | | | |
|---|---|---|---|
| 2,789,716 | 4/1957 | Wolf | 414/626 |
| 3,513,997 | 5/1970 | Heyer et al. | 294/81.54 X |
| 3,558,176 | 1/1971 | Fathauer et al. | 294/81.21 |
| 3,576,269 | 4/1971 | Shaffer | 294/82.21 X |
| 3,688,933 | 9/1972 | Rumell | 294/81.21 X |
| 3,752,346 | 8/1973 | Thompson et al. | 294/81.21 X |
| 3,762,754 | 10/1973 | Goyarts | 294/81.54 |
| 3,767,250 | 10/1973 | Ward | 294/81.21 |
| 3,770,309 | 11/1973 | Merchant et al. | 294/81.21 |
| 3,817,414 | 6/1974 | Peltonen | 294/81.54 X |
| 3,822,077 | 7/1974 | Palen | 294/81.21 |
| 3,829,145 | 8/1974 | Gottlieb et al. | 294/81.53 X |
| 3,905,632 | 9/1975 | Caylor et al. | 294/119.1 |
| 4,017,110 | 4/1977 | Pease et al. | 294/81.21 |
| 4,261,609 | 4/1981 | Kraszewski et al. | 414/621 X |
| 4,388,032 | 6/1983 | Stohler et al. | 414/795.2 |
| 4,396,218 | 8/1983 | Stevens | 294/81.53 X |
| 4,402,543 | 9/1983 | Simpson | 294/81.53 |
| 4,474,495 | 10/1984 | Ledwell, Jr. | 414/621 X |
| 4,579,380 | 4/1986 | Zaremsky et al. | 294/119.1 |
| 4,606,568 | 8/1986 | Karlsson | 414/607 X |
| 4,715,762 | 12/1987 | Lanigan, Sr. et al. | 294/81.21 X |
| 4,844,672 | 7/1989 | Yurgevich | 410/54 |
| 4,852,928 | 8/1989 | Monforte | 294/119.1 X |
| 5,088,783 | 2/1992 | Squires | 294/81.54 |

FOREIGN PATENT DOCUMENTS

| | | | |
|---|---|---|---|
| 74544 | 4/1988 | Japan | 294/81.54 |
| 804421 | 2/1981 | U.S.S.R. | 294/119.1 |
| 1440845 | 11/1988 | U.S.S.R. | 294/81.54 |

*Primary Examiner*—David A. Bucci

*Attorney, Agent, or Firm*—Walker, McKenzie & Walker

[57] ABSTRACT

A container handling apparatus for lifting a container by first and second apertures in opposite sides thereof, comprising: a frame having first and second sides; first and second reciprocating beams mounted to the frame for inward and outward movement with respect thereto, respectively from the first and second sides thereof; first and second inwardly directed pins, respectively attached to clamp heads at the ends of the reciprocating beams, for registered insertion into the container's side apertures; hydraulic cylinders or motor driven screws for reciprocating the beams with respect to the frame between a released condition and a gripping condition; and either a lock wedge operating against a striker plate and aperture or compression washers for causing the reciprocating beams to move inwardly while in the gripping condition so as to track decreases in the width of the container due to bowing as the container is lifted. Proximity switches on the clamp heads sense engagement of the pins with the container's side apertures, and downwardly extending guides locate the frame on the container.

9 Claims, 6 Drawing Sheets

FIG. 13
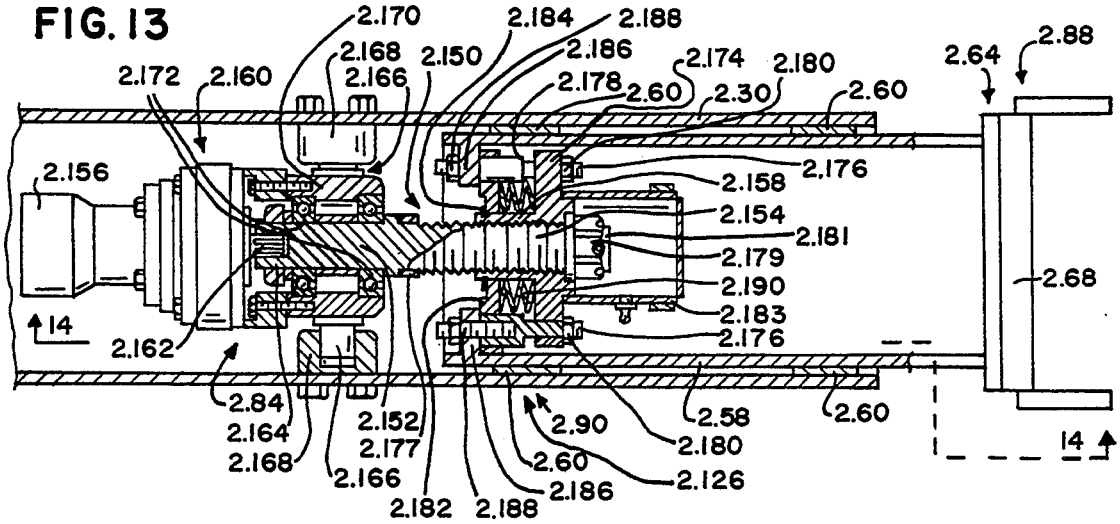
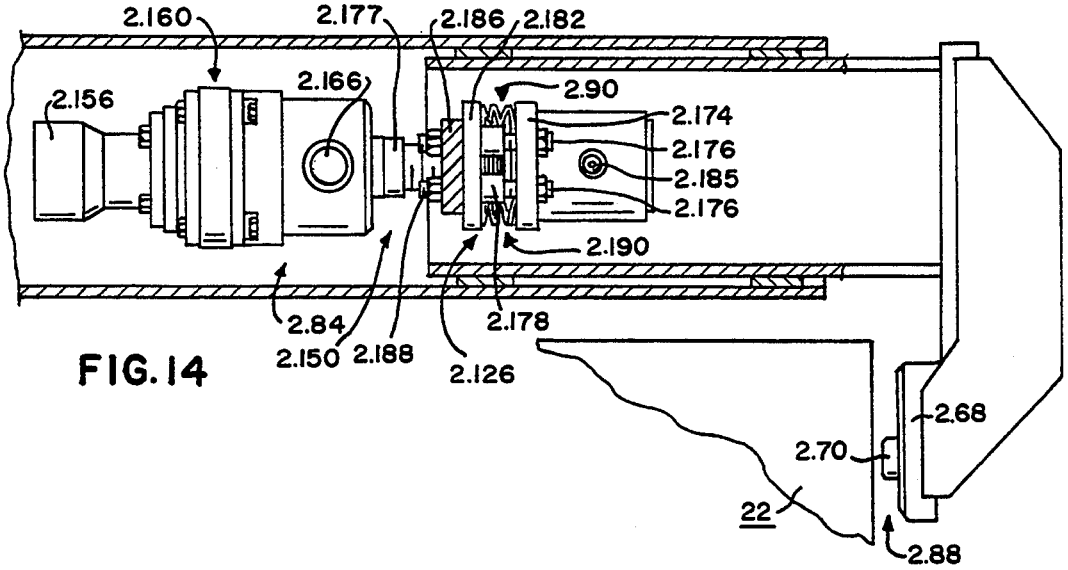
FIG. 14
FIG. 15
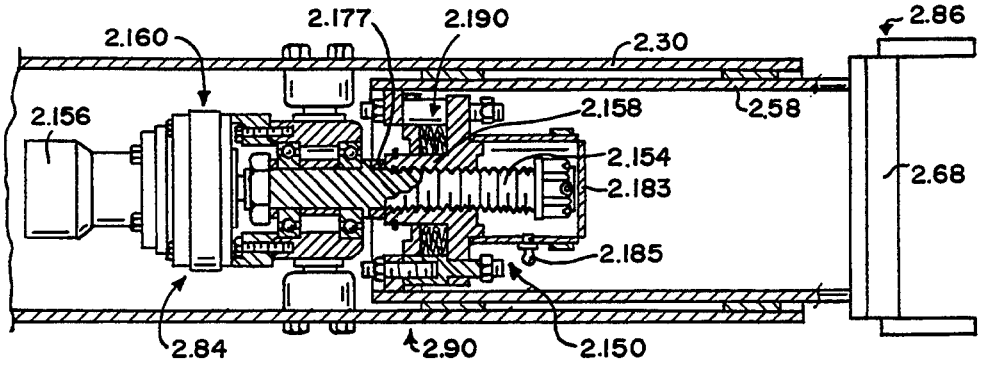

CONTAINER HANDLING APPARATUS

BACKGROUND OF THE INVENTION

1. Field of the Invention

The present invention relates, in general, to container handling apparatus, and in particular, to cargo container handling apparatus as used with hoist means such as cranes and powered industrial lift trucks.

2. Description of the Related Art

Large cargo containers, such as are commonly used to transport freight in the transportation industry, currently have a plurality of coupling receptacles or "twistlock apertures" on the top of the containers for engagement with well-known twistlock couplings on hoist means such as cranes and powered industrial lift trucks equipped with container handler attachments. Currently, international containers having a length of 40 feet 480 inches or 12.19 meters) have four standard heights, namely, 96 inches (244 cm) high, 102 inches (259 cm) high, 108 inches (274 cm) high, and 114 inches (290 cm) high. These containers have ISO twistlock apertures located 19 feet 7.9375 inches (6 meters) either side of the center of the length of the container and 44.48 inches (113 cm) either side of the center of the transverse width of the container.

In recent years, there has been developed what is termed the "high cube" or "domestic" containers which have a length dimension greater than 40 feet (12.19 meters), generally 45, 48, or 53 feet (13.7, 14.6, and 16.2 meters, respectively). All of these newer containers have twistlock apertures located on their top surfaces at 19 feet 7.9375 inches (6 meters) either side of the center of the length of the container and 44.48 inches (113 cm) either side of the center of the transverse width of the container. Because the spacing of these twistlock apertures is the same as that on older ISO containers, the same twistlock lifting equipment may easily handle both the newer "high cube domestic containers" as well as the older ISO containers. There are great numbers of such containers and the associated hoist means, such as cranes and powered industrial lift trucks, for lifting those containers, in use today.

However, the coupling receptacles on these containers protrude approximately 4.5 inches (11.4 cm) downward inside the container, and therefore reduce the dimensions of the usable "envelope" inside the container available for cargo storage. Additionally, the locations of these twistlock apertures and their inward protrusions into the container are much more objectionable in the newer "high cube" containers than in the ISO containers because, in the newer containers, the receptacles are not located in the corners of the container as they were the ISO containers, where they intruded on generally unused cargo space, but instead protrude directly into the usable cargo space, substantially away from the walls and corners of the container.

Freight haulers, as well as those who use the services of the freight haulers, would find it very useful to be able to utilize substantially the entire inside volume of these cargo containers for storage of cargo. Such complete use of the inside volume of the containers was heretofore not possible because of the protrusion of the coupling receptacles inside tile containers, and, therefore, a substantial volume of cargo storage space has been wasted within the containers.

It is therefore desirable to have a cargo handling apparatus that allows the lifting and moving of cargo containers without requiring twistlock coupling receptacles on the tops of the containers that protrude a substantial distance into, and thereby reduce, the container's usable inside storage volume. It is further desirable to provide means for adapting the numerous twistlock hoist means in use today for use with the improved cargo containers that are used with the present invention.

SUMMARY OF THE INVENTION

The present invention is a container handling apparatus for lifting a cargo container by grabbing the container on either side, inserting pins that extend inwardly from opposing clamp heads into side apertures on opposite sides of the container, and maintaining a force by the clamp heads against the container sides. The clamp heads are at the ends of reciprocating beams that extend and retract from the frame of the container handling apparatus. The side apertures on the container replace the twistlock coupling receptacles that heretofore protruded into the cargo containers and reduced the usable internal storage volume.

Two embodiments of the present invention are described, the first having hydraulic cylinders for reciprocating the beams each between a released condition and a gripping condition, and the second having a screw drive for reciprocating each beam.

Tracking means are also described for causing the reciprocating beams to move inwardly when the beams are each in the gripping condition so as to track decreases in the transverse width of the cargo container due to the bowing of the container as it is lifted, thereby ensuring that the pins of the clamp heads remain within the side apertures of the container. The invention may be constructed as a frame with twistlock coupling receptacles on the top thereof for attachment to existing hoist apparatus, thereby adapting such hoist apparatus for use with the containers used by the present invention.

It is an object of the present invention to provide a cargo handling apparatus that lifts various width cargo containers without requiring coupling receptacles that protrude into the interior of the cargo containers.

BRIEF DESCRIPTION OF THE DRAWINGS

FIG. 13 is a partial top sectional view of the screw drive means of the second embodiment, shown in the released condition.

FIG. 14 is a partial end sectional view of the screw drive means of the second embodiment, taken substantially along the line 14—14 shown in FIG. 13.

FIG. 15 is a partial top sectional view of the screw drive means of the second embodiment, similar to FIG. 13, but shown in the gripping condition.

DESCRIPTION OF THE PREFERRED EMBODIMENT

Referring to FIGS. 1–18, two embodiments of the container handling apparatus of the present invention are shown. The two embodiments shall be understood to have many similarities, and differ only in the reciprocation means for moving the reciprocating beams that cause the container to be gripped and also only in the tracking means for causing the reciprocating beams to track decreases in the transverse width of the container due to the bowing thereof as the container is lifted, all in a manner hereinafter explained in detail. The first embodiment, shown in FIGS. 1–11 will first be described, and then the differences between it and the second embodiment, shown in FIGS. 12–15, will be described.

Figure 1:
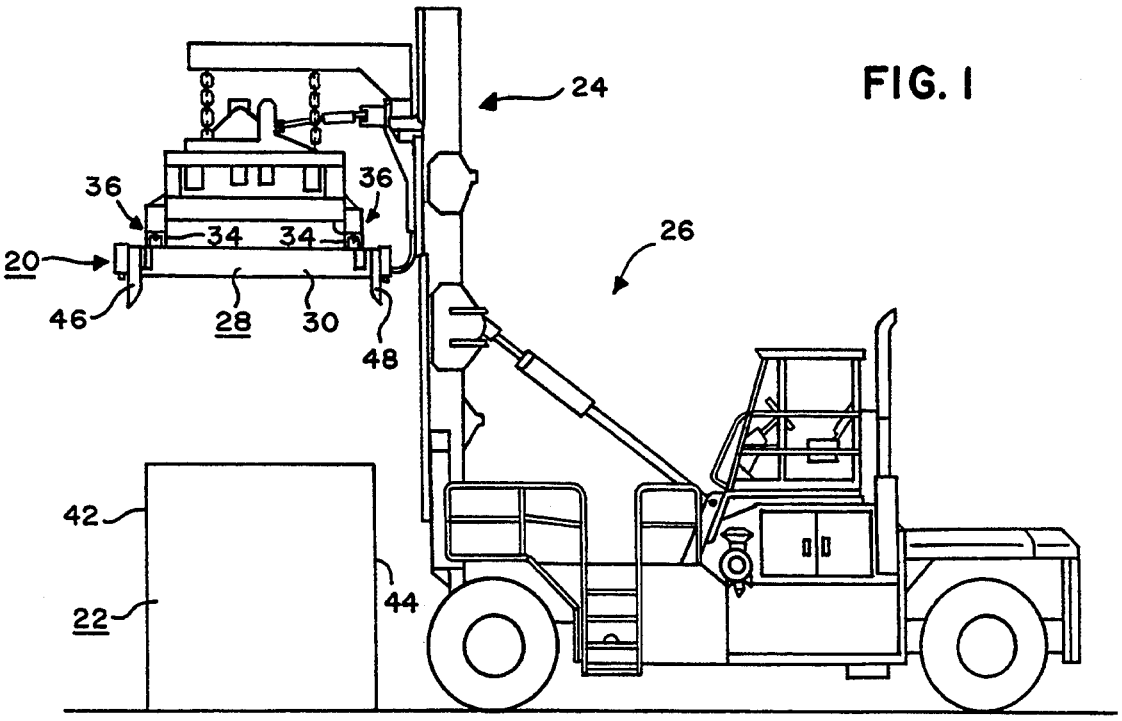
FIG. 1 is an end view of the present invention being lowered onto a container by a powered industrial lift truck.
Figure 2:
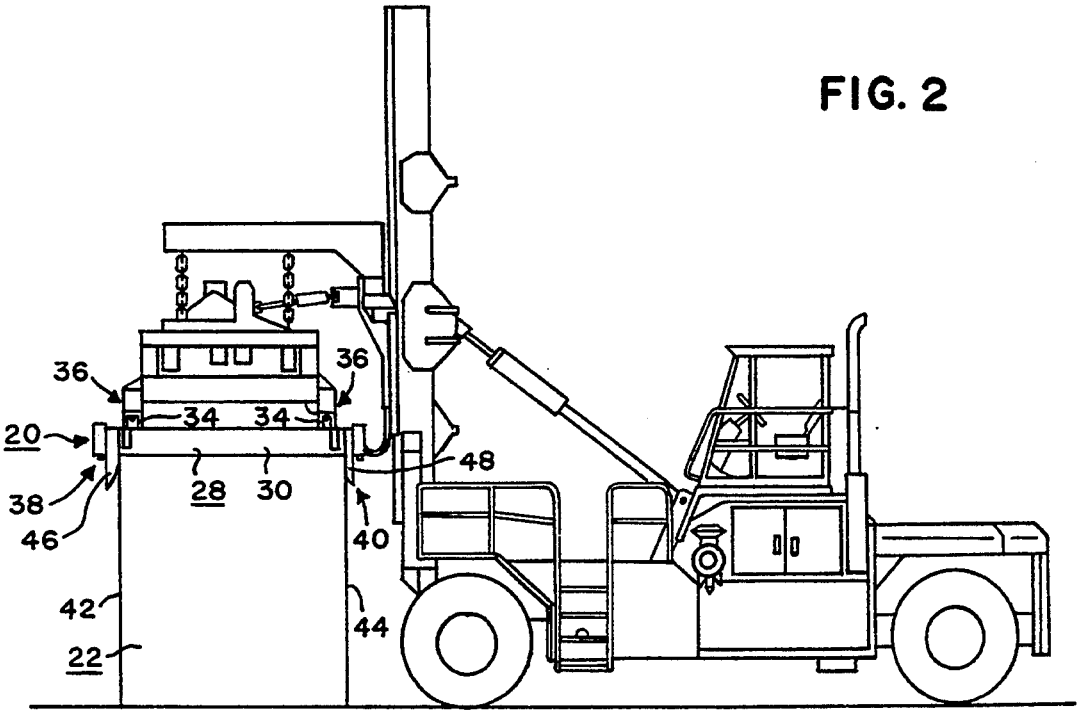
FIG. 2 is an end view of the present invention gripping a container for lifting by a powered industrial lift truck.
Figure 3:
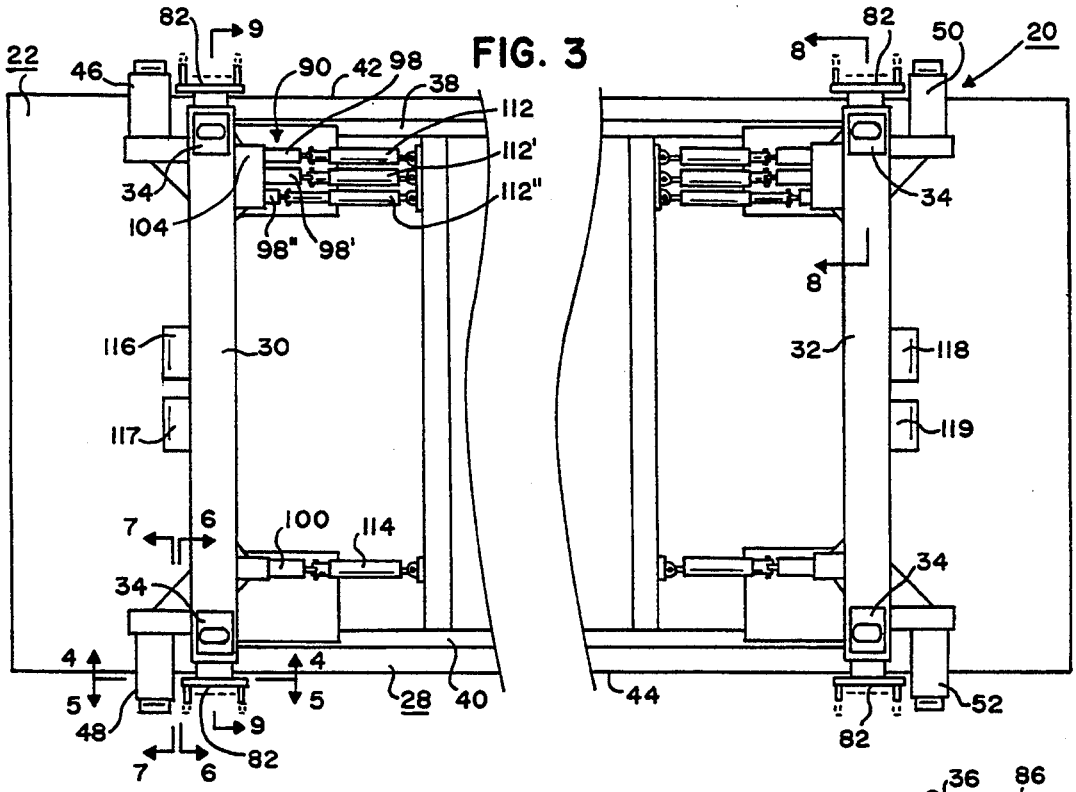
FIG. 3 is a top plan view of a first embodiment of the present invention atop a container.

Referring to FIGS. 1–3, the container handling apparatus 20 of the present invention is shown being lowered onto a container 22 by well-known hoist means 24 such as, for example, a powered industrial lift truck 26 as shown or equivalently, a crane. Container handling apparatus 20 is seen to have a generally beam members 30, 32 spanning the transverse width of the container 22. Well-known twistlock Coupling receptacles 34 may be provided on the upper side of frame 28 for adapting the present invention to be used with existing prior art hoist means, such as hoist means 24, that have well-known downwardly-extending twistlock couplings or fasteners 36 (see FIGS. 1–2 and 6) which previously were for securing to prior art containers in the well-known manner. Alternatively, frame 28 may be lifted directly by hoist means 24 by chains or other means well-known to those skilled in the art without providing for adaptation existing twistlock-type container handling apparatus.

Figure 7:
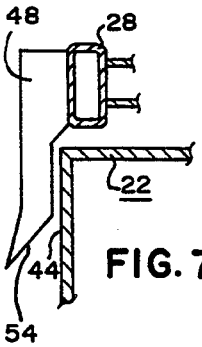
FIG. 7 is a sectional view of the present invention showing one guide means adjacent a side of a container, taken substantially along the line 7—7 shown in FIG. 3.

Frame 28 has first and second sides 38, 40, corresponding to the first and second opposing sides 42, 44 of container 22 on either side thereof as viewed from an end, it being understood for reference, that first (or "front") side 42 is the side of container 22 remote from lift means 24, and that second (or "rear") side 44 is the side of container 22 nearest lift means 24. Attached to frame 28 at first and second sides 38, 40 and downwardly extending therefrom are guide means 46, 48, 50, and 52 (see FIGS. 1–3 and 7) for contacting the sides 42, 44 of container 22 and for guiding container handling apparatus 20 onto container 22. Although only one such guide means is shown in FIG. 7, it shall be understood that all are substantially the same. Preferably, each guide means has an outwardly angled portion 54 on the bottom thereof for guiding frame 28 onto containers 22 that are not in perfect alignment therewith in a manner that will now become apparent.

Referring to FIGS. 3–11, the details of the first embodiment of the present invention may be seen. It shall be understood that the structures of first and second transverse beam members 30, 32 are similar, and a description of one shall suffice for both.

First transverse beam member 30 of frame 28 has first and second reciprocating beams 56 and 58 movably mounted to frame 28 for inward and outward movement with respect thereto. Beam member 30 is preferably a hollow rectangular steel beam, as shown, with first and second reciprocating beams 56 and 58 telescopingly inserted into the opposite ends thereof. Preferably, a plurality of so-called "bearing blocks" 60 surrounds each reciprocating beam as shown, attached as by welding to the inner surface of beam member 30 for slidable telescopic mounting of beams 56 and 58 therewithin in a manner that will now be understood.

Figure 6:
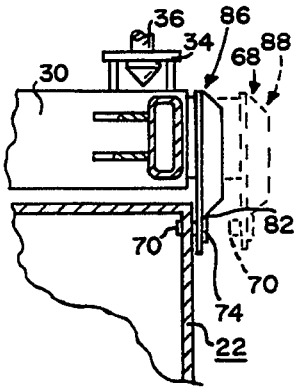
FIG. 6 is an end sectional view of the present invention showing the reciprocating movement of the clamp head, taken substantially along the line 6—6 shown in FIG. 3.

First and second reciprocating beams 56 and 58 each have distal ends, 62 and 64, respectively, remote from frame 28, will clamp heads, 66 and 68, respectively and securely attached thereto as by welding. Each of clamp heads 66 and 68 is similar, and a description of either will suffice for both. Each clamp head has an inwardly-extending horizontal pin 70 for registered insertion into side apertures, hereinafter described, in the sides of container 22. Each pin 70 is preferably 1.5 inches (3.81 cm) to 1.75 inches (4.45 cm) in diameter with a 30° chamfer on the end thereof toward container 22, and each Din 70 preferably extends approximately one inch (2.54 cm) inwardly toward container 22 from the face 72 of the clamp head. Because of the substantial weight of container 22 that must be lifted by each pin 70 in a manner hereinafter described, each pin is preferably fashioned from a casting free of sand pockets and blow holes, then carburized and hardened in a manner well-known to those skilled in the art. As shown in FIG. 6, pin 70 preferably is constructed to extend perpendicularly from a circular mounting plate 74, and pin 70 is then inserted through a hole (not shown) through the clamp head so that pin 70 extends therethrough and inwardly toward container 22, and mounting plate 74 is then secured, as by mounting bolts, to the clamp head in a manner well-known to those skilled in the art.

Figure 4:
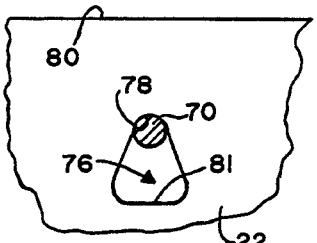
FIG. 4 is a side view of a lifting aperture in the side the container, showing the registration of the lifting pin therein, taken substantially along the line 4—4 shown in FIG. 3.
Figure 16:
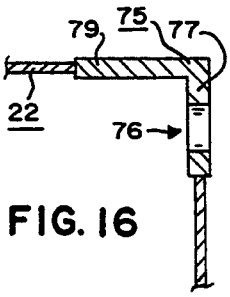
FIG. 16 is a sectional view through the side of the container showing the aperture casting for the lifting aperture of FIG. 4.
Figure 8:
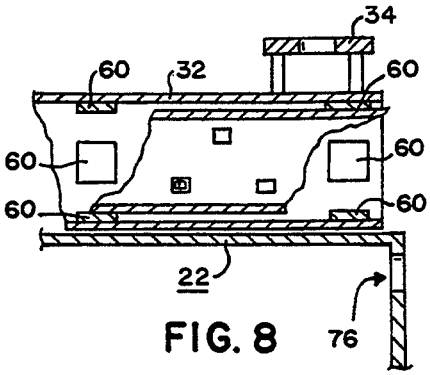
FIG. 8 is a sectional view of the first embodiment of the present invention showing the reciprocation of a beam in the frame, and showing the lock wedge apertures, taken substantially along the line 8—8 shown in FIG. 3.

Container 22 has a plurality of apertures 76, in the sides thereof, one for each clamp head, each substantially as shown in FIGS. 4 and 16, for registered insertion thereinto of pins 70. Although only one such aperture 76 is shown in FIGS. 4 and 16, it shall be understood that each aperture is similar in structure, and a description of one shall suffice for all. Apertures 76 are located on each of first and second sides 42 and 44 of container 22, preferably forty feet (12 meters) apart horizontally as measured along each side, in the standard ISO condition of 19 feet 7.9375 inches (6 meters) either side of center of container 22, with the top 78 of each aperture 76 being located approximately 3.25 inches (8.26 cm) down from the top 80 of container 22. Each aperture 76 is preferably generally triangular in shape with a larger bottom 81 thereof than the top 78, with rounded top and bottom corners, preferably with a rounding radius of approximately 0.89 inches (2.26 cm).

The apertures 76 are preferably formed within the lateral face of right-angled castings 75 (see FIG. 16) that are approximately 19/16 inches (3.02 cm) thick at the side 77 within which the apertures are formed and ½ to 1 inch (1.27 to 2.54 cm) thick at the top 79. When the aperture castings 75 are assembled to and fixedly secured to the containers, with the outsides of the castings more or less flush with the sides of the container with an approximately 102.375 inch (260 cm) transverse width spacing between the outer faces of the castings, the inside width dimension within the container is approximately 100 inches (254 cm), utilizing only ½ inch (1.27 cm) per side of the nominal 101 inch (257 cm) inside dimension of the container for approximately 8 inches (20.3 cm) vertically down from the top of the container and approximately 8 inches (20.3 cm) longitudinally, centered about the aperture. Also, the typical outside roof height of 114 inches to the top of the aperture casting 75 produces an inside height to the aperture casting 75 of 113 to 113.5 inches (287 to 288 cm) for an 8 inch (20.3 cm) linear width.

The improved "side aperture" "high cube" container used with the present invention has the same usable dimensions as the largest available truck trailers, and therefore essentially eliminates any cubeage advantages of shipping by truck or trailer as opposed to containerized shipping, thus making container shipping more competitive with truck/trailer shipping.

Preferably, each container will have vertical stripes painted on its sides, in alignment with the centerline of each aperture 76, for visual guiding alignment with similar vertical stripes painted on the outside 82 of each clamp head in vertical alignment with pin 70.

Container handling apparatus 20 also comprises reciprocation means 84 operably connected between frame 28 and reciprocating beams 56 and 58 for reciprocating beams 56 and 58 each between a gripping condition 86 (see FIG. 6) in which pin 70 is inserted into its respective aperture 76, and a released condition 88 in which pin 70 is not inserted into its respective aperture 76. Preferably, each reciprocating beam 56 and is independently movable between gripping and released conditions 86, 88 in a manner hereinafter described.

Container handling apparatus 20 further preferably comprises tracking means 90 for causing first and second reciprocating beams 56 and 58 to move inwardly when the beams are each in gripping condition 86 so as to track decreases in the transverse width of container 22 due to the bowing thereof as container 22 is lifted. It shall be understood that container 22 is typically of substantial weight, both because of its own weight and further because of the weight of the cargo stored therein. As container 22 is lifted by apparatus 20, container 22 tends to "bow" or bend, and the transverse width, as measured between opposing apertures 76 on the first and second sides 42 and 44 of container 22, tends to decrease slightly due to this bowing and bending of container 22 in a manner that will now be understood.

While this bowing, and consequent decrease in the transverse width, of container 22 was not a problem in the prier art container handling apparatus that lifted containers by twistlock couplings engaged into receptacles on the tops of the containers, the bowing could cause the pins 70 to be released from the side apertures 76 of containers 22 used with the present invention as the transverse width of the containers decreases due to bowing. The different embodiments of reciprocation means 84 and tracking means 90 shall be understood to be the primary differences between the first and second embodiments of the present invention.

Figure 9:
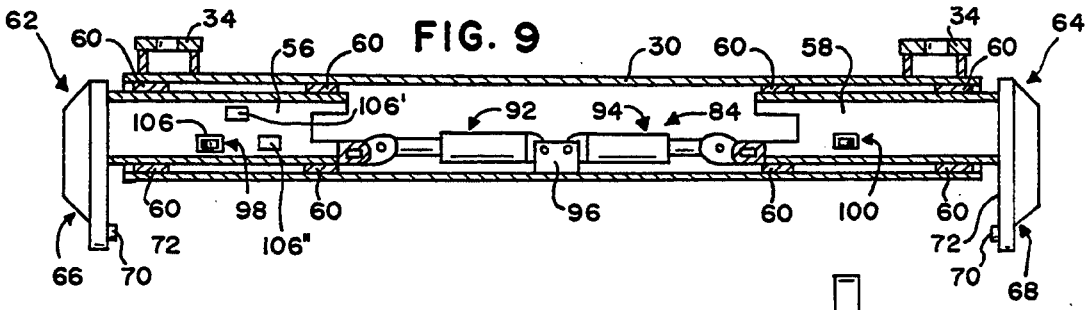
FIG. 9 is an end sectional view of the first embodiment of the present invention showing the first and second hydraulic cylinder means, taken substantially along the line 9-9 shown in FIG. 3.
Figure 10:
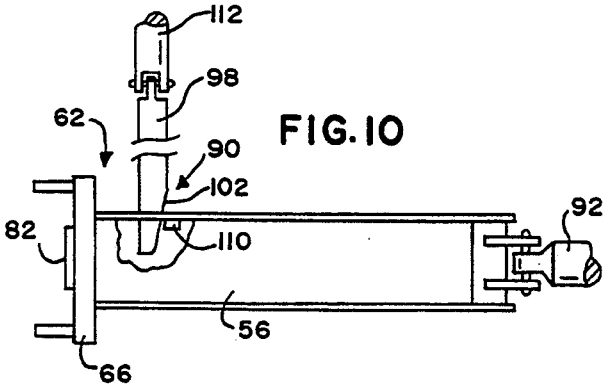
FIG. 10 is a partial top plan view of the first embodiment of the present invention showing the interaction of a lock wedge with a reciprocating beam, with a portion of the beam removed for illustration.

In the first embodiment of the present invention, shown in FIGS. 3-11, reciprocation means 84 comprises first and second hydraulic cylinder means 92 and 94, respectively, for respectively reciprocating first and second reciprocating beams 56 and 58. First hydraulic cylinder means 92 and second hydraulic cylinder means 94 are each similarly constructed of a well-known hydraulic cylinder with internal sliding piston, operably connected between transverse beam member 30 of frame 28 (as by attachment to bracket 96 weldedly secured to beam member 30) and their respective reciprocating beam, 56 or 58, preferably with each end of the respective hydraulic cylinder and piston pivotally secured in the well-known manner as by pins as shown in FIGS. 9 and 10. Each hydraulic cylinder is controlled in the well-known manner from a source of hydraulic power, not shown.

The tracking means 90 of the first embodiment 20 of the present invention comprises first and second lock wedges 98 and 100, respectively, each slidably mounted to frame 28 for transverse movement toward and away from first and second reciprocating beams 56 and 58, respectively. It shall be understood that first and second lock wedges 98 and 100 are similar, and a description of one will suffice for both.

Figure 11:
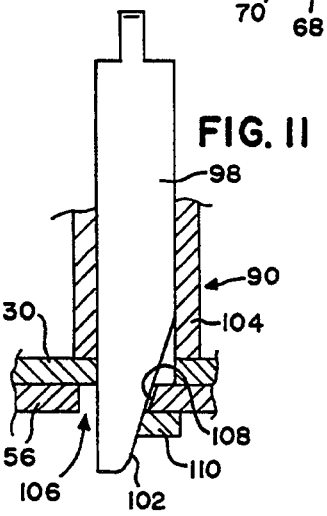
FIG. 11 is a partial sectional view of the first embodiment of the present invention showing the interaction of a lock wedge with a reciprocating beam.

Lock wedge 98 has an inclined surface 102 on the inner side thereof away from clamp head 66. As shown in FIG. 11, lock wedge 98 is slidably mounted within a surrounding and preferably rectangular guide 104, which, in turn, is secured, as by welding, to beam member 30 of frame 28. In this manner, lock wedge 98 is allowed to reciprocate toward and away from reciprocating beam 56 by transverse movement with respect thereto.

Furthermore, reciprocating beam 56 has a so-called striker aperture 106 in its side facing lock wedge 98, with striker aperture 106 further having an inner edge 108 defined to be the edge of aperture 106 away from the respective clamp head, i.e., in this case, clamp head 66. As lock wedge 98 moves transversely toward its reciprocating beam 56 and further into aperture 106, inclined surface 102 of lock wedge 98 will contact with inner edge 108 of aperture 106 and urge beam 56 inwardly while beam 56 is in the gripping condition, thereby allowing and causing beam 56 to move further inwardly but not outwardly while gripping container 22. Each aperture 106 also preferably has a striker plate 110 securely mounted, as by bolting or welding, to its reciprocating beam adjacent inner edge 108, as an extension and reinforcement of the inner edge, for sliding engagement by inner surface 102 of lock wedge 98 therewith, in a manner that will now be apparent.

Each lock wedge is caused to reciprocate by hydraulic cylinder means, such as well-known hydraulic cylinder means 112 that moves lock wedge 98 and well-known hydraulic cylinder means 114 that moves lock wedge 100, each said hydraulic cylinder being operably interposed between frame 28 and the respective lock wedge in a manner that will be understood from examination of FIG. 3. Furthermore, in order to maintain a constant urging of each lock wedge into its respective aperture, as, for instance, the urging of lock wedge 98 into aperture 106, and to also to maintain a constant gripping pressure between the clamp heads and the sides of the container, piston-type accumulators 116, 117, 118, and 119 are used to store hydraulic energy from the source of hydraulic power for the lock wedge hydraulic cylinders and the first and second hydraulic cylinders 92, 94 which reciprocate the reciprocating beams. Accumulators 116, 117, 118, and 119 are well-known piston-type accumulators mounted to beam members 30 and 32, and are preferably such as the model A2A0058A1K 3000 PSI piston-type accumulators manufactured by Parker Actuator Products, 323 Elizabeth Brady Road, Hillsborough, N.C. 27278. As the transverse width of container 22 decreases slightly due to the bowing of the container as it is lifted, the hydraulic pressure within accumulators 116 and 118 supplies a volume of hydraulic fluid to the lock wedge hydraulic cylinders, thereby urging the respective lock wedges 98 and 100 into apertures 106, thereby causing the respective reciprocating beams to move inwardly and track the decreases in transverse width of the container, thereby causing pins 70 to be retained within their respective apertures 76 in the sides of container 22. Accumulators 117 and 119 similarly provide a source of hydraulic pressure to the first and second hydraulic cylinders 92 and 94 to cause them to urge their respective reciprocating beams 56, 58 inwardly in a manner now understood while the beams are each in the gripping condition. The interaction of the four energy-storage accumulators is explained in further detail hereinbelow in the description of the hydraulic circuit of the first embodiment.

Furthermore, to accommodate various standard widths of containers 22, a plurality of lock wedges 98, 98', and 98", and lock wedge hydraulic cylinders 112, 112', and 112" are preferably provided for first telescoping beam 56, with a corresponding plurality of striker apertures 106, 106', and 106" in beam 56, each striker aperture placed at the appropriate position along beam 56 for alignment with a different corresponding lock wedge for each standard container width.

Figure 5:
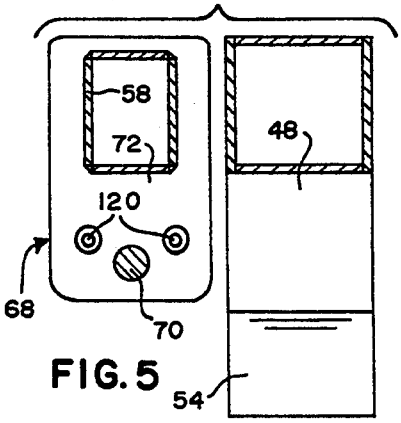
FIG. 5 is a side sectional view of a portion of the present invention showing one guide means and one clamp head, taken substantially along the line 5—5 shown in FIG. 3.

Additionally, as shown in FIG. 5, each clamp head, such as, for example, clamp head 68, preferably has recessed well-known proximity switches 120 for sensing when the respective reciprocating beam, such as beam 58, is in the gripping condition by detecting the nearness or proximity of the side surface of the container to the proximity switch 120. When the proximity of the container face is detected by the proximity switches 120, appropriate signal lights (not shown, and electrically connected to proximity switches 120 in a manner well-known to those skilled in the art) are illuminated to alert the lift operator.

In operation, the first embodiment of the present invention is lowered down onto a container guided by guides 46, 48, 50, and 52, with the reciprocating beams each in the released condition, and the operator lines up the vertical stripes on the clamp heads with similar vertical stripes on the container. Then, the hydraulic cylinders 92 and 94 of each transverse beam member 30, 32 are powered by the source of hydraulic power through their respective accumulators, 117 and 119, to cause each reciprocating beam to move its clamp head and pin into the gripping condition. When the hydraulic pressure experienced by hydraulic cylinders 92 and 94 reaches a predetermined setting, the hydraulic cylinders 112 and 114 are engaged to drive the respective lock wedges 98 and 100 into their respective striker apertures and thereby produce a positive mechanical lock holding reciprocating beams 56 and 58 each in the gripping condition. As the container is lifted and bows due to its enormous weight, the accumulators 117 and 119 supply hydraulic pressure to the hydraulic cylinders that reciprocate the reciprocating beams while accumulators 116 and 118 supply hydraulic pressure to the hydraulic cylinders that engage the lock wedges, thereby tracking changes in the transverse width of the container and maintaining a positive grip on the container with the pins 70 in the apertures 76.

Figure 17:
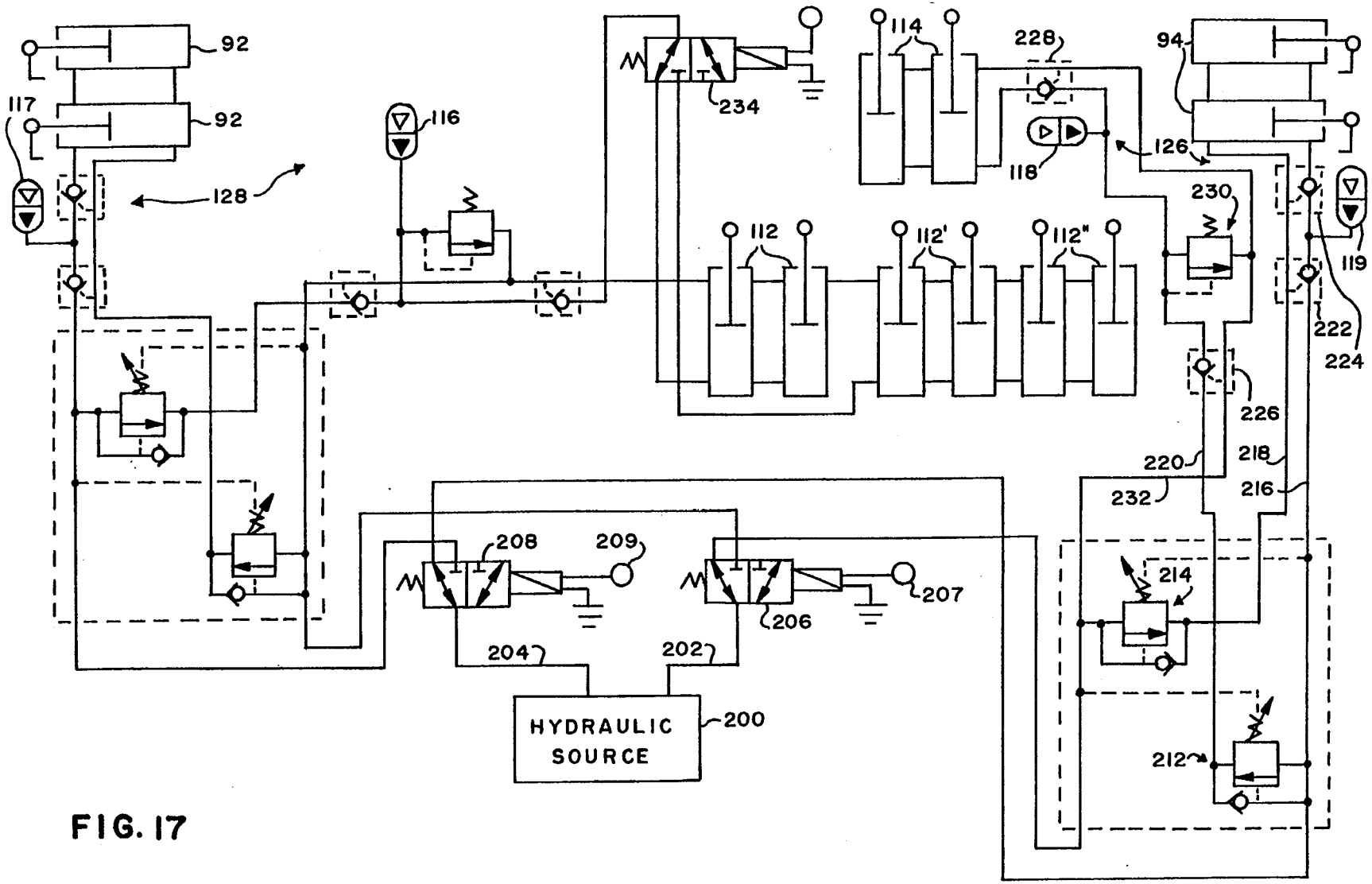
FIG. 17 is a schematic diagram of the hydraulic circuitry for the first embodiment of the present invention.

Turning now to FIG. 17, the details of the hydraulic circuit for the first embodiment is shown. For the sake of completeness, pairs of hydraulic cylinders 92, 94, 112, 112', and 112" are shown, it being understood that one of each pair is on beam member 30 and the other of each pair is on beam member 32, and that both members of each pair act conjointly because the members of each pair are in parallel, in a manner understood by those skilled in the art.

The hydraulic power for the circuit is supplied by a well-known known source of hydraulic power 200 having various well-known spool valves and port reliefs for causing hydraulic fluid to circulate in and out of supply lines 202 and 204 in a manner well-known to those skilled in the art. A typical hydraulic pressure required from source 200 is between 1500–2000 P.S.I. so that clamp cylinders 92 and 94 can properly grip the container. Supply lines 202 and 204 pass through well-known solenoid-operated valves 206 and 208 which allow alternate operation of the circuit in either a "rear clamp" mode as shown, in which hydraulic cylinders 94 and 114 are operated, or a "front clamp " mode in which both valves 206 and 208 are actuated, as by supplying a voltage to nodes 207 and 209 in a manner well-known to those skilled in the art, so that hydraulic cylinders 92, 112, 112', and 112" are operated. Only the "rear clams" mode will be described, it being understood that the details of the operation in "front clamp" mode are similar, as are the elements of the "front clamp" portion-of the circuit.

Typically, the rear clamps operated by hydraulic cylinders 94 will first be operated to engage their lifting pins with the apertures on the rear or second side 44 of the container (see FIG. 3) and lock wedge cylinder 114 operated to engage lock wedge 100 and secure the second reciprocating beams 58. Then, the circuit will be placed into the "front clamp" mode, and hydraulic cylinders 92 will then be operated to engage their lifting pins with the apertures on the front or first side 42 of the container, and the appropriate lock wedge cylinder 112, 112', or 112" used to lock the first reciprocating beams 56. Accumulators 117 and 119 shall be understood to have a first "charge pressure" of typically 800 P.S.I., and accumulators 116 and 118 shall be understood to have a second "charge pressure" of typically 150 P.S.I., for reasons explained hereinafter.

After passing through solenoid valves 206 and 208, hydraulic fluid flows through sequence valves 212 and 214 for sequencing the operation of hydraulic clamp cylinders 92 with lock wedge cylinders 114. Sequence valves 212 and 214 are each well-known dual-position valves having an actuation pressure of typically 1500 P.S.I. When cylinders 94 are operated to retract their pistons, thereby causing their clamp heads to grip the container, hydraulic fluid is supplied through line 216 and returned through line 218. After the clamp heads have contacted the sides of the container and the pistons in hydraulic cylinders 94 travel to the ends of their stroke, the hydraulic pressure within supply line 216 begins to rise. When the pressure in supply line 216 reaches the actuation pressure of valve 212, valve 212 actuates and begins supplying hydraulic pressure to lock wedge cylinders 114 through supply line 220.

Check valve 222 blocks hydraulic fluid from returning down line 216 from cylinders 94, and check valve 224 allows accumulator 119 to feed cylinders 94 and maintain a gripping pressure on the container. As long as hydraulic fluid remains within accumulator 119, it will act as a source of stored energy for cylinders 94 to compensate for leaks and slight movement of the pistons within cylinders 94.

Similarly, check valves 226 and 228 are on either side of accumulator 118 which supplies stored energy to lock wedge cylinders 114. A pressure relief valve 230 is provided to reduce the operating pressure seen by lock wedge cylinders 114 to a lower pressure, typically 400 P.S.I., than that seen by the clamping cylinders 94. Accumulator 118 acts to provide stored energy for cylinders 114 when the hydraulic circuit is no longer in the "rear clamp" mode, ensuring a constant urging of the lock wedge cylinders into the striker apertures in a manner previously described.

It should be understood that these various operating pressures, while offered for the sake of understanding and explanation, are merely experimental values determined to be satisfactory. If the clamping pressure is too great, the structural integrity of the container will be compromised and the container will become crushed. If the clamping pressure is too light, then the inertial forces experienced by the clamp head as the container is lifted and then moved would tend to allow the lifting pins to become disengaged from the side apertures on the container. Similarly, the pressure on the lock wedge cylinders, and the taper of the wedge itself, is chosen so that a proper grip is maintained on the container as the transverse width of the container decreases due to bowing when the container is lifted, and further to maintain a grip as the container shifts during movement due to inertial forces. While, in theory, an inertialess non-deforming container would not require a constant clamping force as the container is lifted, experience has shown that some clamping force is needed to overcome the inertial forces encountered by the clamp head as the container is moved. The accumulators 116, 117, 118, and 119 shall therefore be understood to comprise energy storage means 126 and 128, included as a part of the tracking means 90, previously described, for maintaining a clamping force by the clamp heads upon the sides of the container when the reciprocating beams are each in the gripping condition.

Furthermore, the lock wedge cylinders shall be understood to offer some added degree of safety (in case a hydraulic hose breaks for a clamping (reciprocation) hydraulic cylinder) because of their locking of the reciprocating beams by the lock wedges, thereby preventing the unexpected release of the container should such a hose break occur.

Once the "rear" or second side 44 of the container has been gripped, the operator actuates solenoid-operated valves 206 and 208 to cause the circuit to enter the "front clamp" mode, and cylinders 92 are caused to grip the container in a manner similar to that described for cylinders 94.

As previously explained, a plurality of lock wedge cylinders 112, 112', and 112'' are provided to accommodate the various widths of containers. As shown, the lock wedge cylinders 112' and 112'', for 102⅜ and 102 inch width containers, respectively, are operated conjointly because the tolerances in the striker plates and lock wedges, coupled with the slight width variation between these containers, allows such conjoint operation. However, when 103⅜ inch width containers are lifted and lock wedge cylinders 112 must instead be employed, lock wedge cylinders 112' and 112'' must be disengaged and the hydraulic power instead supplied to lock wedge cylinder 112. To accomplish this purpose, well-known solenoid-operated valve 234 is used to switch between the sets of lock wedge cylinders.

When the flow of hydraulic fluid from source 200 is reversed, as the unclamping cycle is initiated, supply line 232 supplies pressure to lock wedge cylinders 114, causing them to retract their pistons and thereby retract the lock wedges. When the pistons of lock wedge cylinders 114 reach the end of their stroke, the pressure in line 232 rises and eventually reaches the actuation pressure of valve 214, causing the actuation thereof, thereby causing hydraulic fluid to pass through line 218 and thereby extend the reciprocating beams under the operation of hydraulic cylinders 94.

A second embodiment of the present invention is shown in FIGS. 12–15, with identifying reference designators marked similarly to the first embodiment, except with the prefix "2." It shall be understood that many aspects of the two embodiments are substantially the same, and only the differences will be treated in detail. The primary differences between the two embodiments are in the structure of the reciprocation means and the structure of the tracking means. Also, the second embodiment requires no hydraulic accumulators because of differences in the reciprocation means and tracking means, as will soon become apparent.

Figure 12:
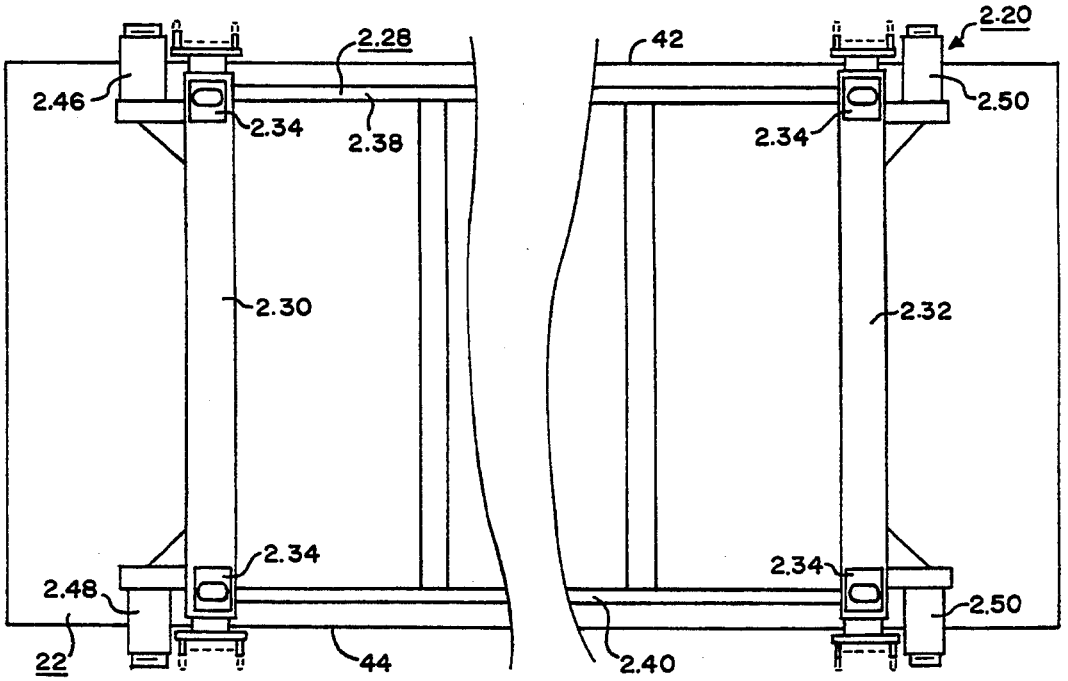
FIG. 12 is a top plan view of a second embodiment of the present invention.

Referring to FIG. 12, the second embodiment 2.20 of the container handling apparatus has a frame 2.28 including transverse beam members 2.30 and 2.32, twist-lock coupling receptacles 2.34 attached to the top of frame 2.28, and downwardly extending guide means 2.46, 2.48, 2.50, and 2.52. Frame 2.28 again has first and second sides 2.38 and 2.40, corresponding to first and second sides 42 and 44 of container 22, and container 22 is substantially as that described for use with the first embodiment.

Referring to FIGS. 13–15, the details of the differences between the two embodiments can be seen. Although views of only one reciprocating beam 2.58 are shown, it shall be understood that all such reciprocating beams and their associated reciprocation and tracking means are similar, and a description of one will suffice for all.

As with the first embodiment, the second embodiment has a clamp head 2.68 fixedly mounted as by welding to distal end 2.64 of reciprocating beam 2.58. Reciprocating beam 2.58 is again slidably mounted within beam member 2.30 upon a plurality of bearing blocks 2.60.

The second embodiment is seen to include reciprocation means 2.84, operably interconnected between reciprocating beam 2.58 and transverse beam member 2.30 of frame 2.28, for reciprocating beam 2.58 between a gripping condition 2.86 shown in FIG. 15 in which pin 2.70 is inserted into the side aperture of container 22 (as with the first embodiment), and a released condition 2.88 shown in FIGS. 13–14 in which pin 2.70 is not inserted into the side aperture. The second embodiment further is seen to include tracking means 2.90 for causing reciprocating beam 2.58 to move inwardly when reciprocating beam 2.58 is in gripping condition 2.86 so as to track decreases in the transverse width of container 22 due to the bowing thereof as container 22 is lifted. It shall be understood that each reciprocating beam of the second embodiment has similar reciprocation means and tracking means connected thereto.

Reciprocation means 2.84 comprises screw drive means 2.150 for reciprocating beam 2.58 comprising: drive shaft 2.152 having a threaded portion 2.154, motor means 2.156 mounted to transverse beam member 2.30 for rotating drive shaft 2.152, and a drive nut 2.158 (preferably bronze) threadedly secured to threaded portion 2.154 and mounted to reciprocating beam 2.58, in a manner hereinafter described, so that drive nut 2.158 may not rotate with respect to reciprocating beam 2.58. Preferably, screw drive means 2.150 also comprises brake means 2.160 for preventing the rotation of drive shaft 2,152 when motor means 2.156 is unpowered, in a manner hereinafter described.

Motor means 2.156 is preferably a well-known reversible high torque, low speed hydraulic motor such as the "S" Series hydraulic motor with Geroler® displacement mechanism, manufactured by the Char-Lynn Division of Eaton, Fluid Power Operations, Minneapolis Division, 15151 Highway 5, Eden Prairies, Minnesota 55344. Brake means 2.160 is preferably a well-known so-called failsafe brake having a spring-loaded brake mechanism that prevents rotation of its output shaft 2.162 when hydraulic power applied to the brake drops below a predetermined threshold. Such a suitable brake is manufactured by the Ausco Company, 2245 Pipestone Road, Benton Harbor, Michigan 49023-8787 under the trade name Ausco Failsafe Brake. It shall be understood that the housing of brake means 2.160 is securely mounted to the housing of motor means 2.156, and the output shaft (not shown) of motor means 2.156 is secured from rotation with respect to shaft 2.162 as by a keyway or spline. Also, output shaft 2.162 of brake means 2.160 is secured from rotation with respect to drive shaft 2.152, as by splines on output shaft 2.162 that engagingly mesh with similar internal splines on first end 2.164 of drive shaft 2.152. Furthermore, the hydraulic power supplied to motor means 2.156 is simultaneously supplied to brake means 2.160 so that, when motor means 2.156 is unpowered, brake means 2.160 prevents the rotation of drive shaft 2.152.

Motor means 2.156 is preferably mounted to beam member 2.30 by a pair of trunion pins 2.166 received in trunion bearings 2.168 secured to beam member 2.30. This trunion mounting of the screw drive means allows slight side-to-side movement and slight rotational movement about the trunion pin as the clamp head grips the container and the container is lifted. The housing 2.170 from which trunion pins 2.166 extend preferably has well-known bearings 2.172 pressed into either end thereof for rotatably mounting and supporting drive shaft 2.152.

Drive nut 2.158 preferably has an outwardly extending flange 2.174 slidably mounted to studs 2.176 as shown for limited sliding movement thereupon. Studs 2.176 have enlarged shoulders 2.178 for restraining the movement of flange 2.174 in one direction, and have nuts 2.180 threaded onto the ends thereof for restraining the movement of flange 2.174 in the other direction. It shall be understood that drive nut 2.158 and flange 2.174 may be integral, or preferably constructed separately with flange 2.174 being secured from rotation with respect to nut 2.158 by means well-known to those skilled in the art such as a set screw, not shown. The movement of drive nut 2.158 on threaded portion 2.154 of drive shaft 2.152 is seen to be limited in one direction by a stop spacer 2.177 encircling drive shaft 2.152 adjacent housing 2.170, and limited in the other direction by a castellated nut 2.179 secured to second end 2.181 of shaft 2.152 in the well-known manner. Preferably, a cover 2.183 forming a grease reservoir thereinside encloses end 2.181 and nut 2.179 for lubrication of threaded portion 2.154 as through grease fitting 2.185.

The enlarged shoulder portions 2.178 of studs 2.176 are secured, as by welding, to a compression plate 2.182 encircling drive nut 2.158, and drive nut 2.158 is mounted by flange 2.174 for sliding longitudinal movement upon studs 2.176 as seen by comparison of FIG. 13 with FIG. 15. The movement of drive nut 2.158 with respect to compression plate 2.182 is limited by a well-known circular retaining clip 2.184 around drive nut 2.158 as shown. Reciprocating beam 2.58 has a pair of flanges 2.186 secured thereto as by welding and extending from either side thereof toward drive shaft 2.152, and compression plate 2.182 is secured to flanges 2.186 by bolts or threaded studs 2.188 in a manner that will now be apparent.

Tracking means 2.90 of the second embodiment comprises a compression spring 2,190 operably interposed between reciprocating beam 2.58 and drive nut 2.158. In the preferred embodiment, compression spring 2.190 is a plurality of well-known so-called Belleville compression washers as shown, encircling drive nut 2.158 and compressed between compression plate 2.182 and flange 2.174 so as to store energy when the two are urged together.

Comparing FIGS. 13 and 15, and beginning in the released condition shown in FIG. 13, as drive shaft 2.152 turns in the tightening direction, drive nut 2.158, being secured from rotation with respect to beam 2.58, is caused to move toward motor means 2,156. Initially, the Belleville compression washers of compression spring 2.190 are relatively uncompressed as compared to FIG. 15, with flange 2.174 against nuts 2.180 and away from compression plate 2.182 under the influence of the compression washers. Beam 2.58 is thus caused to move inwardly with drive nut 2.158 toward the gripping condition.

When beam 2.58 encounters resistance due to the contacting of clamp head 2.68 against the side of container 22, it will be inhibited from inward movement and, as drive nut 2.158 continues to move inwardly, the Belleville compression washers 2.190 will become compressed between flange 2.174 and compression plate 2.182, and will thereby store energy. This compression of the compression washers 2.190 continues for a compression distance of approximately ⅜ inch (0.95 cm) until flange 2.174 is stopped by enlarged shoulder portion 2.178. At this point, the resistance experienced by motor means 2.156 becomes great, and the hydraulic power thereto is shut off, causing brake means 2.160 to lock drive shaft 2.152 from further rotation, and the beam 2.58 is now in the gripping condition with pin 2.70 inserted into its aperture in the side of container 22. As the transverse width of container 22 decreases due to the bowing of the container as it is lifted, the Belleville compression washers 2.190 of tracking means 2.90 will expand, causing compression plate 2.182 to move toward motor means 2.156, thereby moving flanges 2.186 and thereby also moving beam 2.58 in the same direction, causing beam 2.58 to track the decreased width of the container.

It shall be seen that the Belleville compression washers 2.190 of the second embodiment also play a similar energy storage role to that of the accumulators of the first embodiment, and function as energy storage means 2.126 included as part of tracking means 2.90, previously described, for maintaining a clamping force by the clamp heads on the sides of the container when the reciprocating beams are each in the gripping condition. Furthermore, the ⅜ inch limited travel allowed for flange 2,174 upon studs 2,176 ensures that the structural integrity of the container is not compromised, as by crushing, when the clamp heads grip the container, yet still allows resilient resistance to the inertial forces experienced by the clamp head as the container is moved.

The advantage of this second embodiment over the first is the fact that, for a sufficiently long threaded portion 2.154 of drive shaft 2.152, the second embodiment of the container handling apparatus may lift containers of any desired width within the travel limits of the clamping head because the tracking means is not fixed for use with a limited predetermined standard number of widths as in the first embodiment. The brake means 2.160 that locks the drive shaft 2.152 is seen to allow clamping of the clamping head 2.68 onto containers of any one of an infinite number of widths, limited only by the travel of drive nut 2.158 along threaded portion 2.154 of drive shaft 2.152, because the clamping condition may be achieved at virtually any location of drive nut 2.158 along its travel. It shall be understood that, while FIG. 15 shows drive nut 2.158 at the far left extreme of its travel against stop spacer 2.177 for purposes of illustration, in practice the gripping condition can occur at any position of drive nut 2.158 along threaded portion 2.154.

Figure 18:
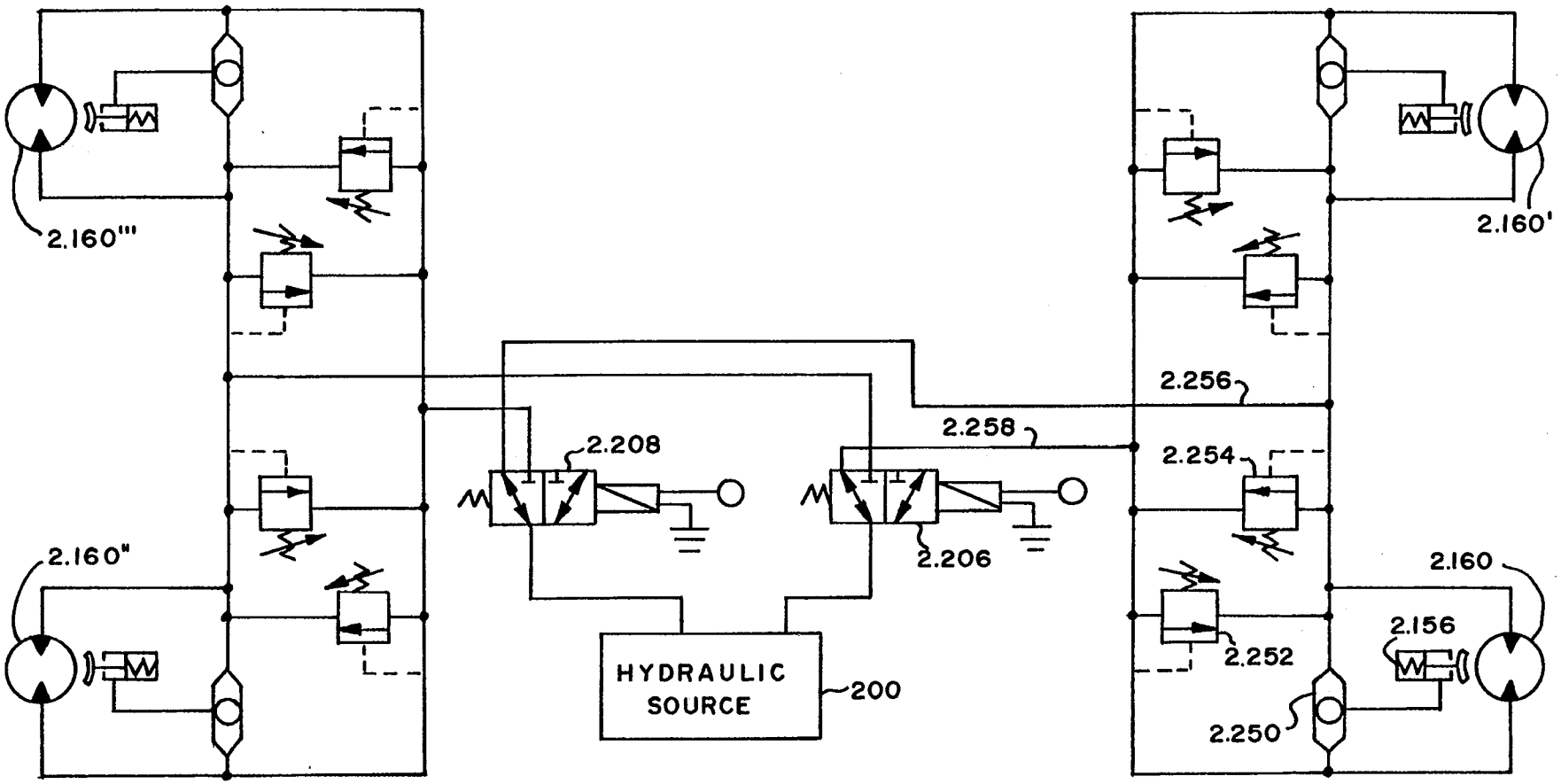
FIG. 18 is a schematic diagram of the hydraulic circuitry for the second embodiment of the present invention.

Turning to FIG. 18, the hydraulic circuit of the second embodiment can now be explained. The structure and operation of all four screw drives is similar, and an explanation of one will suffice for all. It shall be understood that hydraulic motors 2.160 and 2.160' are for gripping the second side 44 of the container, while motors 2.160'' and 2.160''' are for gripping first side 42.

As before, hydraulic source 200 is supplied to the hydraulic circuit through solenoid-operated valves 2.206 and 2.208, which place the circuit in a "rear clamp" mode as shown or a "front clamp" mode for operating the left half of the circuit. As hydraulic source 200 supplies power to motor 2.160 through line 2.256 to turn the motor in one direction, well-known shuttle valve 2.250 is caused to seal off the path to line 2.258 and simultaneously causing a fluid path to be creamed from line 2.256 to brake 2.156, thereby releasing the brake. Motor 2.160 turns, causing its reciprocating beam to retract and grip the container, until the pressure in line 2.256 rises. When the pressure rises, it will cause a well-known pressure-actuated switch (not shown, but operably coupled to hydraulic line 2.256 in a manner well-known to those skilled in the art) to illuminate a signal light (not shown), thereby notifying the operator that the travel for clamping is complete, either by clamping of the clamp head against the container or by the screw drive running out of stroke and hitting the stop. Upon seeing this signal light, the operator then reacts by moving a control on the hydraulic source to disable the source, thereby stopping the screw and causing the brake to be applied because of the consequent drop in hydraulic pressure as the source is disabled.

To ensure that the force from clamping or the hydraulic pressure is not too high, pressure relief valve 2.254 opens at a predetermined pressure and provides a path between supply line 2.256 and return line 2.258 in the shown position of valve 2.206.

When the beam is to be extended away from the container, fluid is supplied instead through line 2.258, causing shuttle valve 2.250 to block off line 2.256 and supply brake 2.156, thereby releasing the brake and allowing the motor to operate in the other direction. When the drive nut reaches the end of its stroke, the pressure rises, pressure relief valve 2.252 actuators to limit the pressure, and, in a manner similar to that described above, a signal light illuminates to notify the operator that the travel of the beam is complete and that the operator should now disable the source of hydraulic fluid, as before. The operator accordingly then disables the hydraulic source, in a manner well-known to those skilled in the art by operating various controls, thereby causing the motor to stop and the brake to be applied.

Although the present invention has been described and illustrated with respect to a preferred embodiment and a preferred use therefor, it is not to be so limited since modifications and changes can be made therein which are within the full intended scope of the invention.

I claim:

1. A container handling apparatus for lifting a container, said container having a first aperture in a first side thereof and having a second aperture in a second opposite side thereof and further having a transverse width measured between said first and said second sides of said container at said apertures, said container handling apparatus comprising:

(a) a frame having a first side and a second side;

(b) first and second reciprocating beams, mounted to said frame for inward and outward movement with respect thereto, respectively from said first and second sides thereof;

(c) first and second pins respectively attached to said first and said second reciprocating beams and extending inwardly therefrom for registered insertion respectively into said first and said second apertures;

(d) reciprocation means operably connected between said frames and said reciprocating beams for reciprocating said first and said second reciprocating beams each between a gripping condition in which said pin of said respective reciprocating beam is inserted into said respective aperture and a released condition in which said pin of said respective reciprocating beam is not inserted into said respective aperture comprising first and second screw drive means for respectively reciprocating said first and said second reciprocating beams, said first screw drive means being operably connected between said frame and said first reciprocating beam, and said second screw drive means being operably connected between said frame and said second reciprocating beam; and;

(e) tracking means for causing said first and said second reciprocating beams to move inwardly when said reciprocating beams are each in said gripping condition so as to track decreases in said transverse width of said container due to the bowing thereof as said container is lifted.

2. The container handling apparatus as recited in claim 1, in which each said screw drive means of said respective first and second reciprocating beams comprises:

(a) a drive shaft having a threaded portion;

(b motor means mounted to said frame for rotating said drive shaft; and (c) a drive nut threadedly secured to said threaded portion and mounted to said respective reciprocating beam so that said drive nut may not substantially rotate with respect to said respective reciprocating beam.

3. The container handling apparatus as recited in claim 2, in which each said screw drive means further comprises brake means for preventing the rotation of said drive shaft when said motor means is unpowered.

4. The container handling apparatus as recited in claim 2, in which each said drive nut is slidably mounted to its said respective reciprocating beam for limited sliding movement parallel to the longitudinal axis of said drive shaft, and in which said tracking means comprises a compression spring operably interposed between said respective reciprocating beam and said drive nut.

5. The container handling apparatus as recited in claim 4, in which said compression spring comprises a plurality of compression washers.

6. The container handling apparatus as recited in claim 1, in which said container handling apparatus includes first and second proximity switch means for sensing when said first and said second reciprocating beams are respectively in said gripping condition.

7. A container handling apparatus for lifting a container, said container having a first aperture in a first side thereof and having a second aperture in a second opposite side thereof and further having a transverse width measured between said first and said second sides of said container at said apertures, said container handling apparatus comprising:

(a) a frame having a first side and a second side;

(b) first and second reciprocating beams, mounted to said frame for inward and outward movement with respect thereto, respectively from said first and said second sides thereof;

(c) first and second pins respectively attached to said first and said second reciprocating beams and extending inwardly therefrom for registered insertion respectively into said first and said second apertures; and (d) reciprocation means operably connected between said frame and said reciprocating beams for reciprocating said first and said second reciprocating beams each between a gripping condition in which said pin of sand respective reciprocating beam is inserted into said respective aperture and a released condition in which said pin of said respective reciprocating beam is not inserted into said respective aperture; said reciprocation means comprising first and second screw drive means for respectively reciprocating said first and said second reciprocating beams, said first screw drive means being operably connected between said frame and said first reciprocating beam, and said second screw drive means being operably connected between said frame and said second reciprocating beam, each said screw drive means comprising:

i. a drive shaft having a threaded portion;

ii. motor means mounted to said frame for rotating said drive shaft; and iii. a drive nut threadedly secured to said threaded portion and mounted to said respective reciprocating beam so that said drive nut may not substantially rotate with respect to said respective reciprocating beam.

8. The container handling apparatus as recited in claim 7, in which each said screw drive means further comprises brake means for preventing the rotation of said drive shaft when said motor means is unpowered.

9. The container handling apparatus as recited in claim 7, in which said container handling apparatus includes first and second proximity switch means for sensing when said first and said second reciprocating beams are respectively in said gripping condition.

* * * * *